US012025144B2

(12) United States Patent
Kimura

(10) Patent No.: US 12,025,144 B2
(45) Date of Patent: Jul. 2, 2024

(54) VACUUM PUMP AND MAGNETIC BEARING

(71) Applicant: SHIMADZU CORPORATION, Kyoto (JP)

(72) Inventor: Hiroaki Kimura, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 18/124,861

(22) Filed: Mar. 22, 2023

(65) Prior Publication Data

US 2023/0313811 A1 Oct. 5, 2023

(30) Foreign Application Priority Data

Mar. 30, 2022 (JP) ..... 2022-057667

(51) Int. Cl.
*F04D 29/048* (2006.01)
*F04D 19/04* (2006.01)
*F04D 29/58* (2006.01)

(52) U.S. Cl.
CPC ..... *F04D 29/048* (2013.01); *F04D 19/042* (2013.01); *F04D 29/582* (2013.01)

(58) Field of Classification Search
CPC .... F04D 29/048; F04D 29/644; F04D 19/048; F05D 2230/642
See application file for complete search history.

(56) References Cited

U.S. PATENT DOCUMENTS 5,667,363 A * 9/1997 Bernhardt ..... F04D 19/048 417/423.4
2007/0024138 A1* 2/2007 Buhler ..... F16C 32/0468 310/90.5
2018/0128386 A1* 5/2018 Heulitt ..... F16K 15/063
2019/0383301 A1* 12/2019 Manabe ..... F04D 19/042
2021/0332824 A1* 10/2021 Yasuda ..... F04D 29/644
2022/0074407 A1* 3/2022 Kabasawa ..... F04D 19/048

FOREIGN PATENT DOCUMENTS

JP 2021-134886 A 9/2021

* cited by examiner

*Primary Examiner* — J. Todd Newton
*Assistant Examiner* — Cameron A Corday
(74) *Attorney, Agent, or Firm* — Renner, Otto, Boisselle & Sklar, LLP

(57) ABSTRACT

A vacuum pump includes a rotor having a shaft, a base housing the shaft, a thrust disc provided at a lower portion of the shaft, and a magnetic bearing supporting the shaft. The magnetic bearing has a first electromagnet arranged to face an upper surface of the thrust disc, and a second electromagnet arranged to face a lower surface of the thrust disc. The second electromagnet includes a core. The core includes a fastening portion provided with a through-hole into which a bolt that fastens the core to the base is to be inserted. The thickness of the fastening portion in a depth direction of the through-hole is greater than the nominal diameter of the bolt, or the center position of the fastening portion in the depth direction of the through-hole is higher than the center position of the second electromagnet in an up-down direction.

7 Claims, 4 Drawing Sheets

VACUUM PUMP AND MAGNETIC BEARING

CROSS-REFERENCE TO RELATED APPLICATIONS

This application claims priority to Japanese Patent Application No. 2022-57667 filed on Mar. 30, 2022 before the Japanese Patent Office, the contents of which are incorporated herein by reference in their entirety.

BACKGROUND

1. Technical Field

The present disclosure relates to a vacuum pump and a magnetic bearing.

2. Background Art

There is a vacuum pump that includes a rotor to be rotatably driven and a stator cooperating with the rotor to pump out gas. A shaft of the rotor is housed in a base, and is supported by a magnetic bearing. The magnetic bearings include a bearing (radial magnetic bearing) supporting a shaft in a radial direction and a bearing (thrust magnetic bearing) supporting a shaft in an axial direction (e.g., JP-A-2021-134886).

SUMMARY

Of the above-described magnetic bearings, the thrust magnetic bearing is fastened to a lower portion of the base with a fastening member such as a bolt. The base is made of, e.g., aluminum, whereas the thrust magnetic bearing is made of a magnetic material such as an iron-based material. That is, the base and the thrust magnetic bearing are different from each other in the coefficient of thermal expansion. The vacuum pump has a probability that a portion of the thrust magnetic bearing fastened to the base deforms due to the difference in the coefficient of thermal expansion and the thrust magnetic bearing deforms more than the thrust magnetic bearing upon attachment. Deformation of the thrust magnetic bearing might lead to a problem in operation of the vacuum pump, such as inaccurate sensing of the position of the shaft in the axial direction.

A vacuum pump includes a rotor, a base, a thrust disc, and a magnetic bearing. The rotor has a shaft. The base rotatably houses the shaft. The thrust disc is provided at a lower portion of the shaft. The magnetic bearing supports the shaft in an axial direction by levitating the thrust disc. The magnetic bearing has a first electromagnet and a second electromagnet. The first electromagnet is arranged so as to face an upper surface of the thrust disc. The second electromagnet is arranged so as to face a lower surface of the thrust disc. The second electromagnet includes a core and a coil. The core includes a fastening portion provided with a through-hole into which a bolt for fastening the core to the base is to be inserted. In the vacuum pump, the thickness of the fastening portion in a depth direction of the through-hole is greater than the nominal diameter of the bolt that fastens the fastening portion to the base, or the center position of the fastening portion in the depth direction of the through-hole is higher than the center position of the second electromagnet in an up-down direction.

In the vacuum pump of the present disclosure as described above, the thickness of the fastening portion in the depth direction of the through-hole is greater than the nominal diameter of the bolt that fastens the fastening portion to the base. Since the strength of the fastening portion can be improved by the large thickness of the fastening portion, the fastening portion is less likely to deform upon heating of the vacuum pump even with a difference in the coefficient of thermal expansion between the base and the fastening portion. As a result, deformation of the magnetic bearing due to heating can be reduced. On the other hand, in a case where the center position of the fastening portion in the depth direction of the through-hole is higher than the center position of the second electromagnet in the up-down direction, since a distance from the position of contact between the base and an upper end surface of the magnetic bearing to the position of contact between the fastening portion and the base is short, the fastening portion is less susceptible to thermal expansion of the base. As a result, deformation of the magnetic bearing due to heating can be reduced.

DETAILED DESCRIPTION

Figure 1:
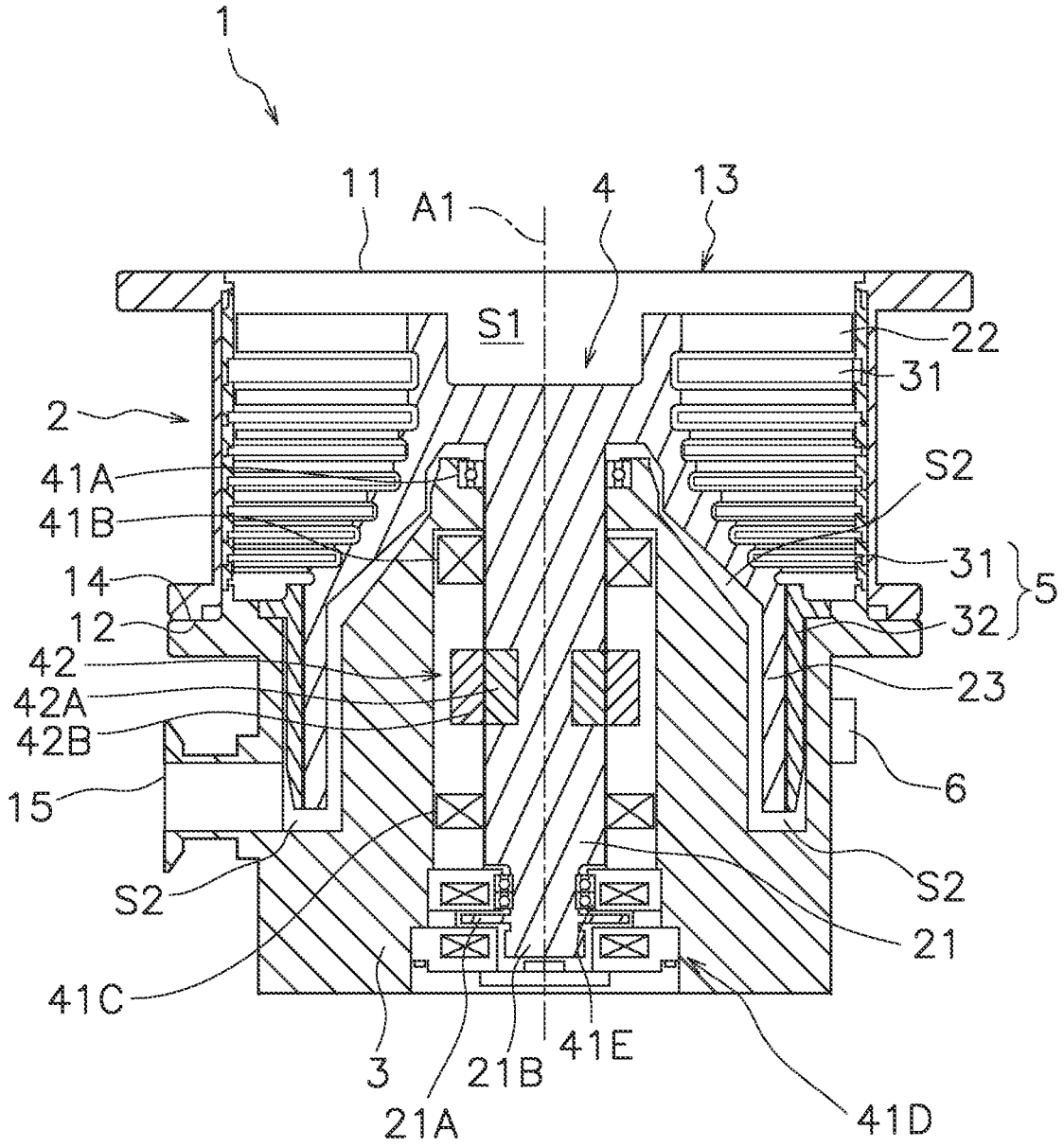
FIG. 1 is a sectional view of a vacuum pump.

Hereinafter, a vacuum pump will be described with reference to the drawings. FIG. 1 is a sectional view of the vacuum pump 1. As shown in FIG. 1, the vacuum pump 1 includes a housing 2, a base 3, a rotor 4, and a stator 5.

The housing 2 includes a first end portion 11, a second end portion 12, and a first internal space S1. A suction port 13 is provided at the first end portion 11. The first end portion 11 is attached to a pumping target device. The pumping target device is, for example, a process chamber of a semiconductor manufacturing device. The first internal space S1 communicates with the suction port 13. The second end portion 12 is positioned opposite to the first end portion 11 in the direction of the axis of the rotor 4 (hereinafter merely referred to as an "axis direction A1"). The second end portion 12 is connected to the base 3. The base 3 includes a base end portion 14. The base end portion 14 is connected to the second end portion 12 of the housing 2. The base 3 is, for example, an aluminum member.

The rotor 4 includes a shaft 21. The shaft 21 extends in the axis direction A1. The shaft 21 is rotatably housed in the base 3. A thrust disc 21A is provided at a lower portion of the shaft 21. Further, a target 21B is screwed to a lower end of the shaft 21.

The rotor 4 includes multiple stages of rotor blades 22 and a rotor cylindrical portion 23. The multiple stages of the rotor blades 22 are connected to the shaft 21. The multiple rotor blades 22 are arranged at intervals in the axis direction A1. The multiple stages of the rotor blades 22 radially extend about the shaft 21. The rotor cylindrical portion 23 is arranged below the multiple stages of the rotor blades 22. The rotor cylindrical portion 23 extends in the axis direction A1.

The stator 5 is arranged on an outer peripheral side of the rotor 4. The stator 5 includes multiple stages of stator blades 31 and a stator cylindrical portion 32. The multiple stages of the stator blades 31 are connected to an inner surface of the housing 2. The multiple stages of the stator blades 31 are arranged at intervals in the axis direction A1. Each stage of the stator blades 31 is arranged between adjacent ones of the multiple stages of the rotor blades 22. The multiple stages of the stator blades 31 radially extend about the shaft 21. The stator cylindrical portion 32 is fixed in contact with the base 3. The stator cylindrical portion 32 is arranged so as to face the rotor cylindrical portion 23 with a slight clearance in a radial direction of the rotor cylindrical portion 23. A spiral groove is provided at an inner peripheral surface of the stator cylindrical portion 32 facing the rotor cylindrical portion 23.

As shown in FIG. 1, an exhaust space S2 is formed further on a downstream side with respect to exhaust-downstream-side end portions of the rotor cylindrical portion 23 and the stator cylindrical portion 32. Pumping target gas pumped from the pumping target device is guided into the exhaust space S2. The exhaust space S2 communicates with an exhaust port 15. The exhaust port 15 is provided at the base 3. Another vacuum pump is connected to the exhaust port 15. Note that the exhaust downstream side represents a side closer to the exhaust space S2 in the axis direction A1. Moreover, an exhaust downstream direction indicates a direction toward the exhaust space S2.

The vacuum pump 1 includes a heater 6. The heater 6 heats the base 3 to adjust the temperature of the base 3. The base 3 is heated by the heater 6 so that accumulation of a product on members of the vacuum pump 1 can be reduced.

The vacuum pump 1 includes bearings 41A, 41E, magnetic bearings 41B to 41D, and a motor 42. The bearings 41A, 41E are attached to the shaft 21 housed in the base 3. The bearings 41A, 41E rotatably support the shaft 21. The bearings 41A, 41E are ball bearings. The magnetic bearings 41B to 41D are bearings supporting the shaft 21 by magnetic force. Of these bearings, the magnetic bearings 41B, 41C are radial magnetic bearings supporting the shaft 21 in the radial direction. The magnetic bearing 41D is a thrust magnetic bearing supporting the shaft 21 in the axial direction.

The motor 42 rotatably drives the rotor 4. The motor 42 includes a motor rotor 42A and a motor stator 42B. The motor rotor 42A is attached to the shaft 21. The motor stator 42B is attached to the base 3. The motor stator 42B is arranged so as to face the motor rotor 42A.

In the vacuum pump 1, the multiple stages of the rotor blades 22 and the multiple stages of the stator blades 31 form a turbo-molecular pump portion. The rotor cylindrical portion 23 and the stator cylindrical portion 32 form a screw groove pump portion. In the vacuum pump 1, the rotor 4 is rotated by the motor 42, and accordingly, the pumping target gas flows into the first internal space S1 through the suction port 13. The pumping target gas in the first internal space S1 passes through the turbo-molecular pump portion and the screw groove pump portion, and is guided into the exhaust space S2. The pumping target gas in the exhaust space S2 is pumped out through the exhaust port 15. As a result, the inside of the pumping target device attached to the suction port 13 is brought into a high vacuum state.

Figure 2:
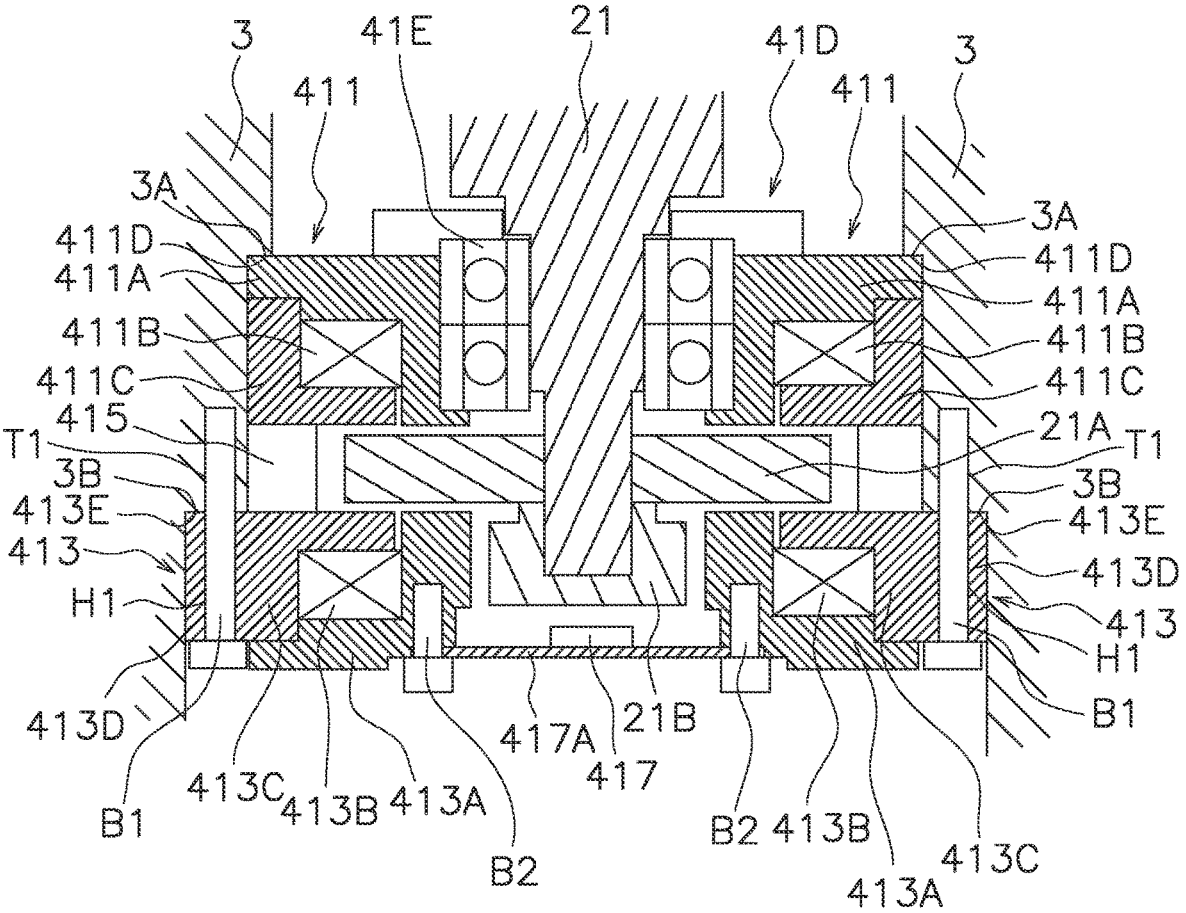
FIG. 2 is a view showing an entire configuration of a magnetic bearing.
Figure 3:
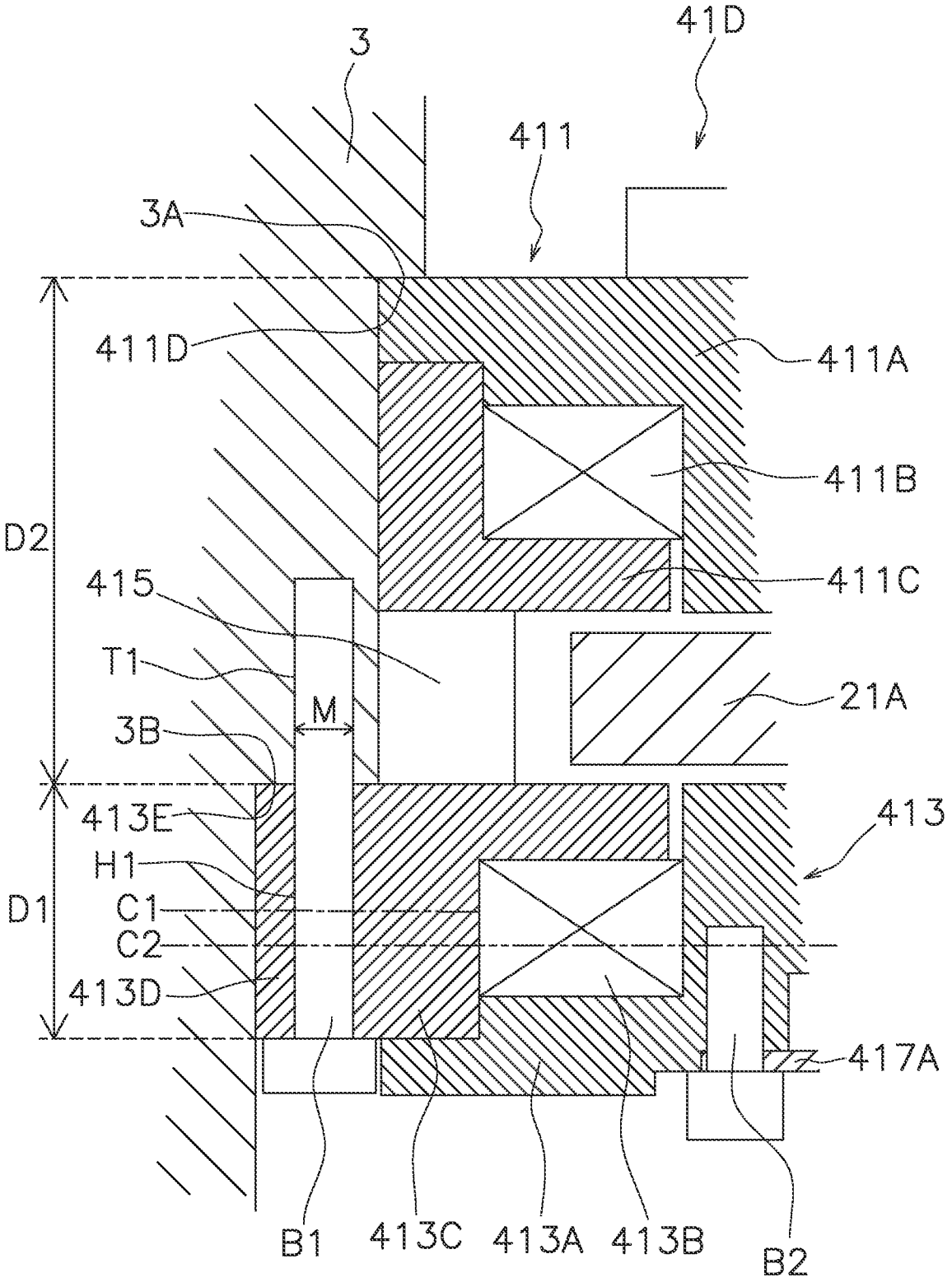
FIG. 3 is an enlarged view of the magnetic bearing.

Next, a detailed configuration of the magnetic bearing 41D will be described with reference to FIGS. 2 and 3. FIG. 2 is a view showing an entire configuration of the magnetic bearing 41D. FIG. 3 is an enlarged view of the magnetic bearing 41D. The magnetic bearing 41D includes a first electromagnet 411 and a second electromagnet 413.

The first electromagnet 411 is arranged so as to face an upper surface of the thrust disc 21A to generate a magnetic field for generating force to attract the thrust disc 21A in an upward direction. The first electromagnet 411 includes a first inner core 411A, a first coil 411B, and a first outer core 411C. The first inner core 411A is a cylindrical member arranged so as to face the upper surface of the thrust disc 21A. The first inner core 411A is made of a material having a high magnetic permeability. For example, the first inner core 411A is made of an iron-based material. The bearing 41E is arranged on an inner peripheral side of the first inner core 411A. The bearing 41E supports the shaft 21 in the radial direction.

The first coil 411B is arranged on an outer peripheral side of the first inner core 411A, and by current application, generates a magnetic field for generating force to attract the thrust disc 21A in the upward direction. The first outer core 411C is arranged so as to surround a lower side of the first coil 411B and a side of the first coil 411B closer to the base 3. The first outer core 411C is made of a material having a high magnetic permeability. For example, the first outer core 411C is made of an iron-based material.

With the above-described configuration, the first electromagnet 411 is configured such that the first coil 411B is surrounded by the first inner core 411A positioned closer to the shaft 21 than the first coil 411B and the first outer core 411C positioned closer to the base 3 than the first coil 411B. Since the first inner core 411A and the first outer core 411C have high magnetic permeabilities, the first electromagnet 411 having the above-described configuration can generate a great magnetic field for the thrust disc 21A.

The second electromagnet 413 is arranged so as to face a lower surface of the thrust disc 21A to generate a magnetic field for generating force to attract the thrust disc 21A in a downward direction. The second electromagnet 413 includes a second inner core 413A, a second coil 413B, and a second outer core 413C. The second inner core 413A is a cylindrical member arranged so as to face the lower surface of the thrust disc 21A. The second inner core 413A is made of a material having a high magnetic permeability. For example, the second inner core 413A is made of an iron-based material. In a space on an inner peripheral side of the second inner core 413A, the target 21B provided at the lower end of the shaft 21 is arranged.

The second coil 413B is arranged on an outer peripheral side of the second inner core 413A, and by current application, generates a magnetic field for generating force to attract the thrust disc 21A in the downward direction. The second outer core 413C is arranged so as to surround an upper side of the second coil 413B and a side of the second coil 413B closer to the base 3. The second outer core 413C is made of a material having a high magnetic permeability. For example, the second outer core 413C is made of an iron-based material.

With the above-described configuration, the second electromagnet 413 is configured such that the second coil 413B is surrounded by the second inner core 413A positioned closer to the shaft 21 and the second outer core 413C positioned closer to the base 3. Since the second inner core 413A and the second outer core 413C have high magnetic permeabilities, the second electromagnet 413 having the above-described configuration can generate a great magnetic field for the thrust disc 21A.

The second outer core 413C includes a fastening portion 413D. The fastening portion 413D is integrated with the second outer core 413C, and protrudes from the second outer core 413C toward the base 3. The fastening portion 413D is provided with a through-hole H1 into which a bolt B1 that fastens the second outer core 413C to the base 3 is to be inserted. Moreover, a screw groove T1 for screwing the bolt B1 is provided at a second groove 3B of the base 3. The bolt B1 inserted into the through-hole H1 is screwed to the screw groove T1 with an upper end surface 413E of the fastening portion 413D contacting the second groove 3B of the base 3, and in this manner, the fastening portion 413D is fastened to the second groove 3B of the base 3. The fastening portion 413D is fastened to the second groove 3B of the base 3, and accordingly, the second electromagnet 413 is fastened to the base 3.

After the fastening portion 413D has been fastened to the base 3 with the bolt B1, a spacer member 415 arranged between the first electromagnet 411 and the second electromagnet 413 supports a lower surface of the first outer core 411C. Moreover, an upper end surface 411D of the first inner core 411A contacts a first groove 3A of the base 3. The upper end surface 411D contacts the first groove 3A while the spacer member 415 supports the first outer core 411C from below, and accordingly, the first electromagnet 411 is fixed to the base 3. In this manner, the entirety of the magnetic bearing 41D is fixed to the base 3 with the bolt B1.

The magnetic bearing 41D includes a sensor 417. The sensor 417 is attached to a lower portion of the second inner core 413A. Specifically, a sensor support member 417A on which the sensor 417 is arranged is fixed, with a bolt B2, to the lower portion of the second inner core 413A. In this manner, the sensor 417 is arranged, at the lower portion of the second inner core 413A, so as to face the target 21B. The sensor 417 senses the position of the target 21B, thereby sensing the position of the shaft 21 in an up-down direction. Note that the "up-down direction" described herein means a direction parallel with the axial direction (axis direction A1) of the shaft 21.

The magnetic bearing 41D having the above-described configuration balances the force of the first electromagnet 411 attracting the thrust disc 21A in the upward direction and the force of the second electromagnet 413 attracting the thrust disc 21A in the downward direction, thereby levitating the thrust disc 21A between the first electromagnet 411 and the second electromagnet 413. In this manner, the magnetic bearing 41D can support the shaft 21 in the axial direction.

In the vacuum pump 1, after the magnetic bearing 41D has been fixed to the base 3, a reference position of the shaft 21 is determined in a state in which the base 3 is not heated. Specifically, when the shaft 21 is arranged at the reference position in a state in which the base 3 is not heated, the reference position is determined based on the position of the target 21B sensed by the sensor 417.

As described above, the material forming the base 3 and the material forming the fastening portion 413D are different from each other, and for this reason, there is a probability that the fastening portion 413D deforms, when the base 3 is heated, from the state when the base 3 is not heated due to a difference in the coefficient of thermal expansion between the base 3 and the fastening portion 413D. The fastening portion 413D is integrated with the second outer core 413C, and the second inner core 413A is fixed to the second outer core 413C. For this reason, there is a probability that when the fastening portion 413D deforms, the sensor support member 417A fastened to the second inner core 413A deforms. Due to deformation of the sensor support member 417A, the position of the sensor 417 with respect to the target 21B changes accordingly. As a result, there is a probability that the position of the sensor 417 changes, upon heating of the base 3, from that before heating of the base 3 and the sensor 417 erroneously senses the position of the shaft 21 in the up-down direction.

Thus, in order to reduce deformation of the fastening portion 413D upon heating of the base 3, the thickness D1 of the fastening portion 413D in a depth direction of the through-hole H1 is greater than the nominal diameter M of the bolt B1 in the vacuum pump 1, as shown in FIG. 3. The "depth direction of the through-hole H1" indicates the up-down direction, i.e., the direction parallel with the axial direction of the shaft 21. The thickness D1 is set greater so that the strength of the fastening portion 413D can be improved, and therefore, the fastening portion 413D is less likely to deform even upon heating of the base 3.

In the vacuum pump 1, the center position C1 of the fastening portion 413D in the depth direction of the through-hole H1 is higher than the center position C2 of the second electromagnet 413 in the up-down direction. With this configuration, a distance D2 between the position of contact between the upper end surface 411D of the first inner core 411A and the base 3 and the position of contact between the upper end surface 413E of the fastening portion 413D and the base 3 is shorter than that in a typical case. Thus, the fastening portion 413D is less susceptible to thermal expansion of the base 3, and therefore, the fastening portion 413D is less likely to deform even upon heating of the base 3.

As described above, the fastening portion 413D is less likely to deform due to heating of the base 3, and therefore, deformation of the magnetic bearing 41D (the sensor support member 417A thereof) before and after heating of the base 3 can be reduced. As a result, the position of the sensor 417 with respect to the target 21B is less likely to change before and after heating of the base 3. This can prevent the sensor 417 from erroneously sensing the position of the shaft 21 in the up-down direction upon heating of the base 3.

Note that it has been confirmed by experiment as follows: the fastening portion 413D is configured as described above so that deformation of the fastening portion 413D upon heating of the base 3 can be reduced to such an extent that the sensor 417 does not erroneously sense the position of the shaft 21 in the up-down direction.

In the vacuum pump 1, the fastening portion 413D is included in the second outer core 413C. The second outer core 413C has a simpler shape than that of the second inner core 413A. Thus, the second outer core 413C has a higher stiffness than that of the second inner core 413A. Consequently, the fastening portion 413D is provided in the second outer core 413C so that the strength of the fastening portion 413D can be further improved.

As a comparative example, in a case where the thickness of a fastening portion is set smaller than the nominal diameter of a bolt B1 and the center position of the fastening portion in a depth direction of a through-hole is lower than the center position of a second electromagnet in an up-down direction, the fastening portion greatly deforms upon heating of a base 3 and the sensor 417 erroneously senses the position of a shaft 21 in the up-down direction in some cases.

One embodiment of the present disclosure has been described above, but the present disclosure is not limited to the above-described embodiment and various changes can be made without departing from the gist of the disclosure.

Figure 4:
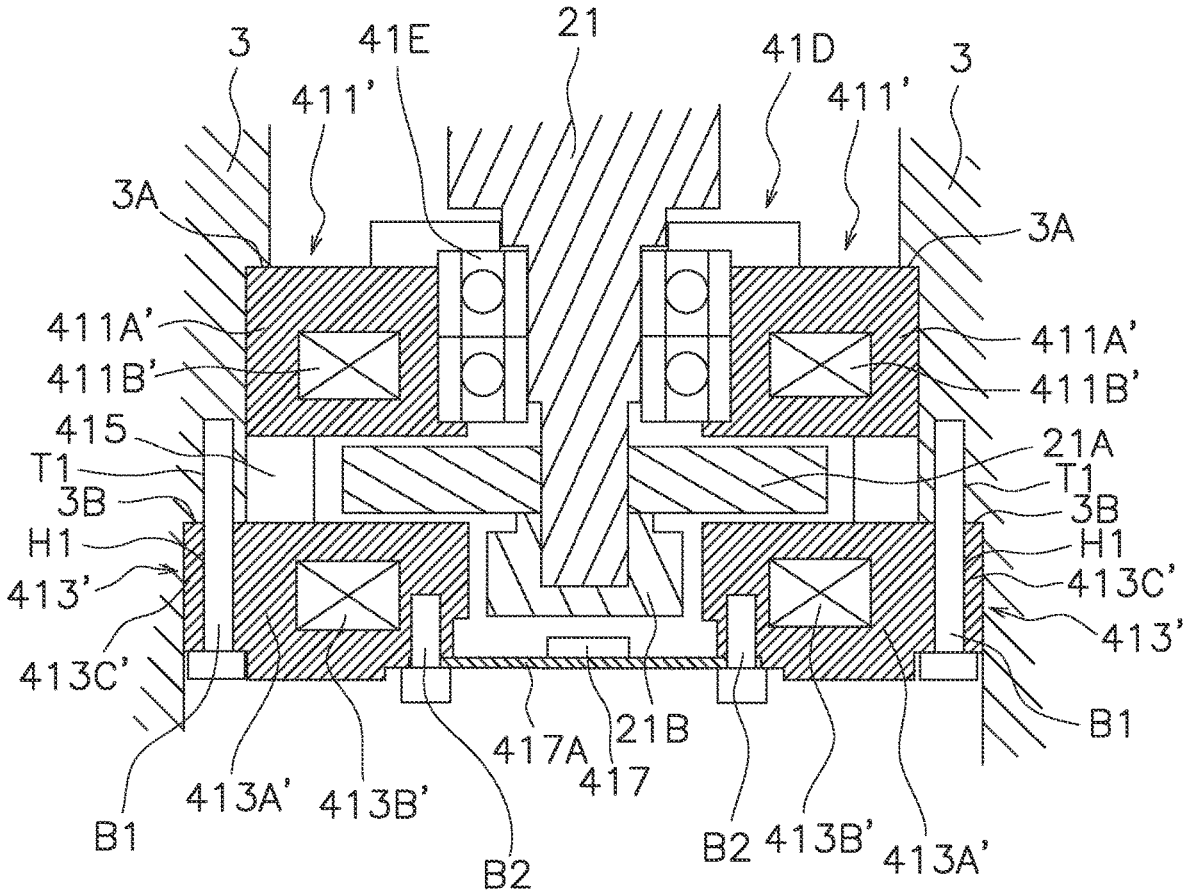
FIG. 4 is a view showing a modification of the magnetic bearing.

As shown in FIG. 4, a second electromagnet 413' may include one second core 413A' and a second coil 413B' arranged inside the second core 413A'. FIG. 4 is a view showing a modification of the magnetic bearing 41D. In this case, a fastening portion 413C' is provided closer to the base 3 than the second core 413A' is to the base 3. The thickness of the fastening portion 413C' in the depth direction of the through-hole H1 is greater than the nominal diameter of the bolt B1, and the center position of the fastening portion 413C' in the depth direction of the through-hole H1 is higher than the center position of the second electromagnet 413' in the up-down direction.

Further, a first electromagnet 411' may include one first core 411A' and a first coil 411B' arranged inside the first core 411A'.

Deformation of the fastening portion 413D can also be reduced to such an extent that the sensor 417 does not erroneously sense the position of the shaft 21 in the up-down direction only in such a manner that the thickness D1 of the fastening portion 413D in the depth direction of the through-hole H1 is set greater than the nominal diameter M of the bolt B1 or the center position C1 of the fastening portion 413D in the depth direction of the through-hole H1 is higher than the center position C2 of the second electromagnet 413 in the up-down direction.

The vacuum pump 1 according to the above-described embodiment is the pump configured such that the turbo-molecular pump including the multiple stages of the rotor blades 22 and the multiple stages of the stator blades 31 and the screw groove pump including the rotor cylindrical portion 23 and the stator cylindrical portion 32 are integrated. However, the screw groove pump may be omitted. That is, the vacuum pump 1 may be a turbo-molecular pump. Alternatively, the turbo-molecular pump may be omitted. That is, the vacuum pump 1 may be a screw groove pump.

Those skilled in the art understand that the above-described multiple exemplary embodiments are specific examples of the following aspects.

(First Aspect) A vacuum pump includes a rotor, a base, a thrust disc, and a magnetic bearing. The rotor has a shaft. The base rotatably houses the shaft. The thrust disc is provided at a lower portion of the shaft. The magnetic bearing supports the shaft in an axial direction by levitating the thrust disc. The magnetic bearing has a first electromagnet and a second electromagnet. The first electromagnet is arranged so as to face an upper surface of the thrust disc. The second electromagnet is arranged so as to face a lower surface of the thrust disc. The second electromagnet includes a core and a coil. The core includes a fastening portion provided with a through-hole into which a bolt that fastens the core to the base is to be inserted. In the vacuum pump, the thickness of the fastening portion in a depth direction of the through-hole is greater than the nominal diameter of the bolt fastening the fastening portion to the base, or the center position of the fastening portion in the depth direction of the through-hole is higher than the center position of the second electromagnet in an up-down direction.

In the vacuum pump according to the first aspect, the thickness of the fastening portion in the depth direction of the through-hole is greater than the nominal diameter of the bolt that fastens the fastening portion to the base. Since the strength of the fastening portion can be improved by the large thickness of the fastening portion, the fastening portion is less likely to deform upon heating of the vacuum pump even with a difference in the coefficient of thermal expansion between the base and the fastening portion. As a result, deformation of the magnetic bearing due to heating can be reduced. On the other hand, in a case where the center position of the fastening portion in the depth direction of the through-hole is higher than the center position of the second electromagnet in the up-down direction, since a distance from the position of contact between the base and an upper end surface of the magnetic bearing to the position of contact between the fastening portion and the base is short, the fastening portion is less susceptible to thermal expansion of the base. As a result, deformation of the magnetic bearing due to heating can be reduced.

(Second Aspect) In the vacuum pump according to the first aspect, the thickness of the fastening portion in the up-down direction may be greater than the nominal diameter of the bolt, and the center position of the fastening portion in the up-down direction may be higher than the center position of the second electromagnet in the up-down direction. In the vacuum pump according to the second aspect, since the fastening portion is less susceptible to thermal expansion of the base while the strength of the fastening portion is improved, deformation of the magnetic bearing upon attachment due to heating can be further reduced.

(Third Aspect) In the vacuum pump according to the first aspect or the second aspect, the core may have an outer core with the fastening portion and an inner core positioned closer to the shaft than the outer core. In the vacuum pump according to the third aspect, since the fastening portion is provided in the outer core having a higher stiffness than that of the inner core, the strength of the fastening portion can be improved.

(Fourth Aspect) The vacuum pump according to any one of the first to third aspects may further include a sensor attached to a lower portion of the core to sense the position of the shaft in the up-down direction. In the vacuum pump according to the fourth aspect, the magnetic bearing is less likely to deform before and after heating of the base. Thus, the position of the sensor attached to the lower portion of the core does not change much before and after heating of the base. As a result, in the vacuum pump according to the fourth aspect, erroneous sensing of the position of the shaft in the up-down direction by the sensor upon heating of the base can be reduced.

(Fifth Aspect) The vacuum pump according to any one of the first to fourth aspects may further include a heater configured to adjust the temperature of the base. In the vacuum pump according to the fifth aspect, accumulation of a product can be reduced by heating of the base. Moreover, deformation of the magnetic bearing before and after heating of the base by the heater can be reduced.

(Sixth Aspect) In the vacuum pump according to any one of the first to fifth aspects, the base may be made of aluminum, and the fastening portion may made of an iron-based material. Even if the base and the fastening portion are made of the materials with different coefficients of thermal expansion, the strength of the fastening portion is improved or the fastening portion is less susceptible to thermal expansion of the base. Thus, the magnetic bearing is less likely to deform before and after heating of the base.

(Seventh Aspect) A magnetic bearing supports, in a vacuum pump including a rotor having a shaft, a base rotatably housing the shaft, and a thrust disc provided at a lower portion of the shaft, the shaft in an axial direction by levitating the thrust disc. The magnetic bearing includes a first electromagnet and a second electromagnet. The first electromagnet is arranged so as to face an upper surface of the thrust disc. The second electromagnet is arranged so as to face a lower surface of the thrust disc. The second electromagnet includes a core and a coil. The core includes a fastening portion provided with a through-hole into which a bolt that fastens the core to the base is to be inserted. In the magnetic bearing, the thickness of the fastening portion in a depth direction of the through-hole is greater than the nominal diameter of the bolt, or the center position of the fastening portion in the depth direction of the through-hole is higher than the center position of the second electromagnet in an up-down direction.

In the magnetic bearing according to the seventh aspect, the thickness of the fastening portion in the depth direction of the through-hole is greater than the nominal diameter of the bolt fastening the fastening portion to the base. Since the strength of the fastening portion can be improved by the large thickness of the fastening portion, the fastening portion is less likely to deform upon heating of the vacuum pump even with a difference in the coefficient of thermal expansion between the base and the fastening portion. As a result, deformation of the magnetic bearing due to heating can be reduced. On the other hand, in a case where the center position of the fastening portion in the depth direction of the through-hole is higher than the center position of the second electromagnet in the up-down direction, since a distance from the position of contact between the base and an upper end surface of the magnetic bearing to the position of contact between the fastening portion and the base is short, the fastening portion is less susceptible to thermal expansion of the base. As a result, deformation of the magnetic bearing due to heating can be reduced.

What is claimed is:

1. A vacuum pump comprising:

a rotor having a shaft;

a base rotatably housing the shaft;

a thrust disc provided at a lower portion of the shaft; and a magnetic bearing supporting the shaft in an axial direction by levitating the thrust disc, wherein the magnetic bearing has a first electromagnet arranged so as to face an upper surface of the thrust disc, and a second electromagnet arranged so as to face a lower surface of the thrust disc, the second electromagnet includes a core and a coil, the core includes a fastening portion provided with a through-hole into which a bolt that fastens the core to the base is to be inserted, and a thickness of the fastening portion in a depth direction of the through-hole is greater than a nominal diameter of the bolt, or a center position of the fastening portion in the depth direction of the through-hole is higher than a center position of the second electromagnet in an up-down direction.

2. The vacuum pump according to claim 1, wherein a thickness of the fastening portion in the up-down direction is greater than the nominal diameter of the bolt, and a center position of the fastening portion in the up-down direction is higher than the center position of the second electromagnet in the up-down direction.

3. The vacuum pump according to claim 1, wherein the core has an outer core with the fastening portion and an inner core positioned closer to the shaft than the outer core.

4. The vacuum pump according to claim 1, further comprising:

a sensor attached to a lower portion of the core to sense a position of the shaft in the up-down direction.

5. The vacuum pump according to claim 1, further comprising:

a heater configured to adjust a temperature of the base.

6. The vacuum pump according to claim 1, wherein the base is made of aluminum, and the fastening portion is made of an iron-based material.

7. A magnetic bearing that supports, in a vacuum pump including a rotor having a shaft, a base rotatably housing the shaft, and a thrust disc provided at a lower portion of the shaft, the shaft in an axial direction by levitating the thrust disc, comprising:

a first electromagnet arranged so as to face an upper surface of the thrust disc; and a second electromagnet arranged so as to face a lower surface of the thrust disc, wherein the second electromagnet includes a core and a coil, the core includes a fastening portion provided with a through-hole into which a bolt that fastens the core to the base is to be inserted, and a thickness of the fastening portion in a depth direction of the through-hole is greater than a nominal diameter of the bolt, or a center position of the fastening portion in the depth direction of the through-hole is higher than a center position of the second electromagnet in an up-down direction.

* * * * *